US005675983A

United States Patent [19]

Ibrahim

[11] Patent Number: 5,675,983

[45] Date of Patent: Oct. 14, 1997

[54] SYNERGISTIC REFRIGERATED DISPLAY CASE

[75] Inventor: Fayez F. Ibrahim, Niles, Mich.

[73] Assignee: Kysor Industrial Corporation, Cadillac, Mich.

[21] Appl. No.: 712,081

[22] Filed: Sep. 11, 1996

[51] Int. Cl.[6] ..... A47F 3/04

[52] U.S. Cl. ..... 62/255; 62/256

[58] Field of Search ..... 62/255, 256

[56] References Cited

U.S. PATENT DOCUMENTS

| | | | |
|---|---|---|---|
| 2,705,875 | 4/1955 | Pichler | 62/256 |
| 5,009,080 | 4/1991 | Naganuma et al. | 62/256 |

FOREIGN PATENT DOCUMENTS

| | | | |
|---|---|---|---|
| 11560 | 1/1979 | Japan | 62/256 |
| 30253 | 5/1979 | Japan | 62/256 |
| 50065 | 2/1990 | Japan | 62/256 |

*Primary Examiner*—William E. Tapolcai
*Attorney, Agent, or Firm*—Price, Heneveld, Cooper, DeWitt and Litton

[57] ABSTRACT

A refrigerated display case having an upper display space for food products at a temperature above freezing, and a lower wall display space for food products at a temperature below freezing, a single set of refrigeration coils adjacent said well, with refrigerated air propelled from said coils during the refrigeration cycle to both the upper and lower spaces, including across the open top of the lower space, and through the upper space between its shelves and its front doors, and with warmed defrost air during the defrost cycle flowing through the coils and circulated only around the lower space while air in the upper space remains substantially dormant.

21 Claims, 5 Drawing Sheets

SYNERGISTIC REFRIGERATED DISPLAY CASE

BACKGROUND OF THE INVENTION

This invention relates to refrigerated display cases and particularly to those that have an upper glass door space for refrigerated storage and display of food products at a temperature above freezing, and a lower, open top well space for refrigerated storage and display of frozen food items at a temperature below freezing. This basic type of case is available today and is particularly popular in Europe and Eastern Asia. The upper glass door space has a refrigeration coil and circulating fans to circulate refrigerated air around the upper space. The lower well has a refrigeration coil and circulating fans to circulate below freezing temperature refrigerated air around the lower space and across the open top to form an air curtain.

FIGS. 5 and 6 herein depict presently available prior art display cases of this type. FIG. 5 shows a case with the upper coil above the upper display space. FIG. 6 shows a case with the upper coil behind the upper display space.

Typically, refrigerated display case coils, particularly those for frozen food refrigeration, require periodic defrost in order to remove a layer of frost which has formed on the coil due to condensation and freezing of moisture in the air flowing through it. To defrost these coils, the evaporative cooling action is deactuated and warm air is forced through the coil to melt the frost. The coils for the upper space may not require as frequent defrosting as the coils for the bottom space.

SUMMARY OF THE INVENTION

An object of this invention is to provide a unique refrigerated display case of the type having an upper space preferably closed by glass doors, for storing and displaying foods above freezing temperature, and a lower space preferably of the open top, well-type for storing and displaying frozen foods, but requiring only a single refrigeration coil device for both the upper and lower spaces. The upper and lower spaces are uniquely combined and arranged so as to enable the same coil to cool both spaces during the refrigeration cycle, and allow defrost of the lower coil during the defrost cycle, yet without warm air being circulated through or around the upper space during this defrost cycle. The requirement of only one set of coils results in considerable savings in initial coil equipment and refrigeration conduits to and from the coils, as well as subsequent operational and maintenance savings. The air circulated around the upper space can be caused to be at a higher temperature than that circulated around the lower space. The air discharged from the upper space forms a secondary air curtain across the open top of the lower space, in cooperation with the primary air curtain formed by air circulating around the lower space and across the open top thereof.

These and other objects, advantages and features of the invention will become apparent upon studying the following detailed specification in conjunction with the drawings.

DETAILED DESCRIPTION OF PREFERRED EMBODIMENTS

Figure 1:
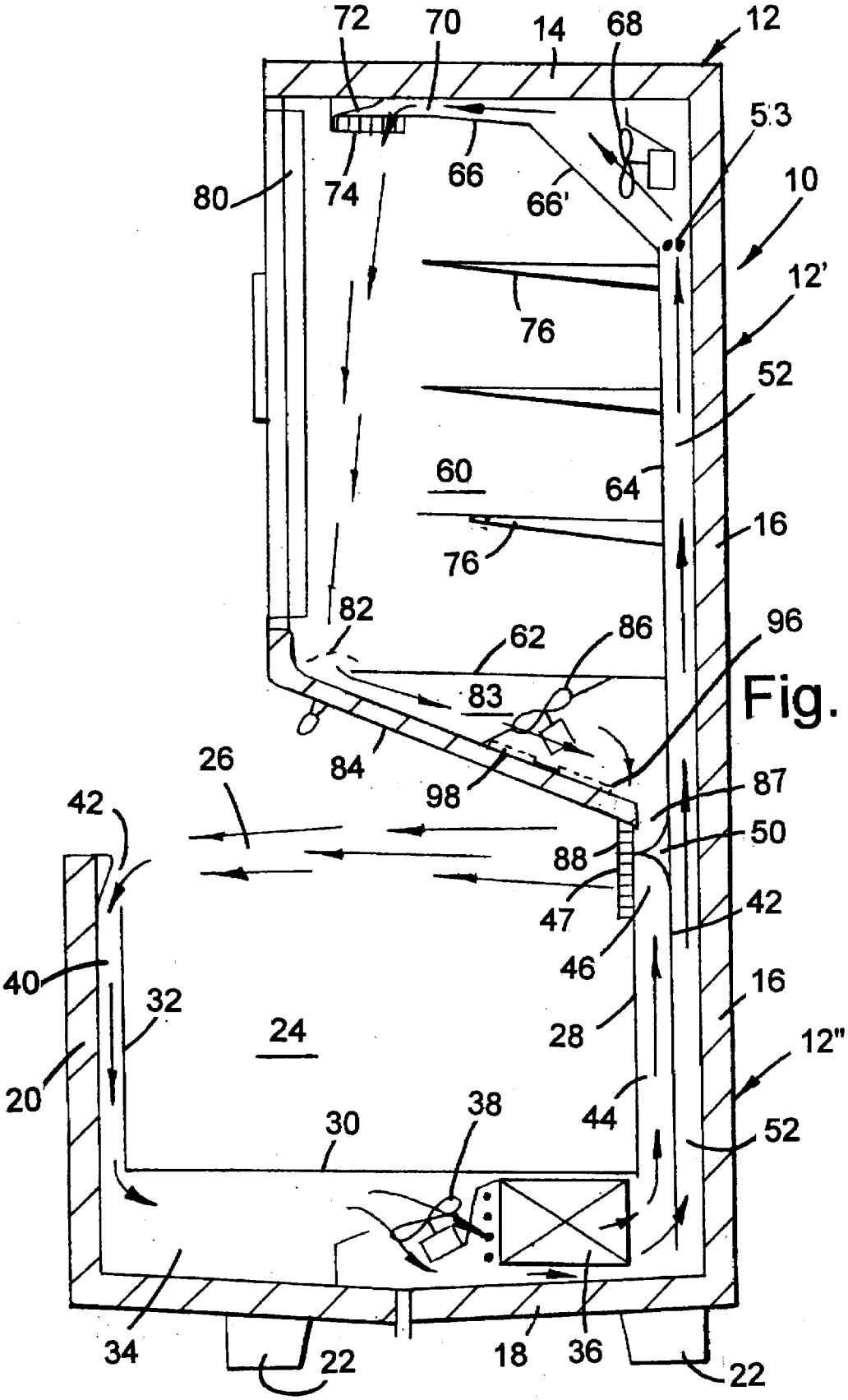
FIG. 1 is an end elevational sectional view of the first embodiment of the novel refrigerated display case, showing air flow during refrigeration.
Figure 2:
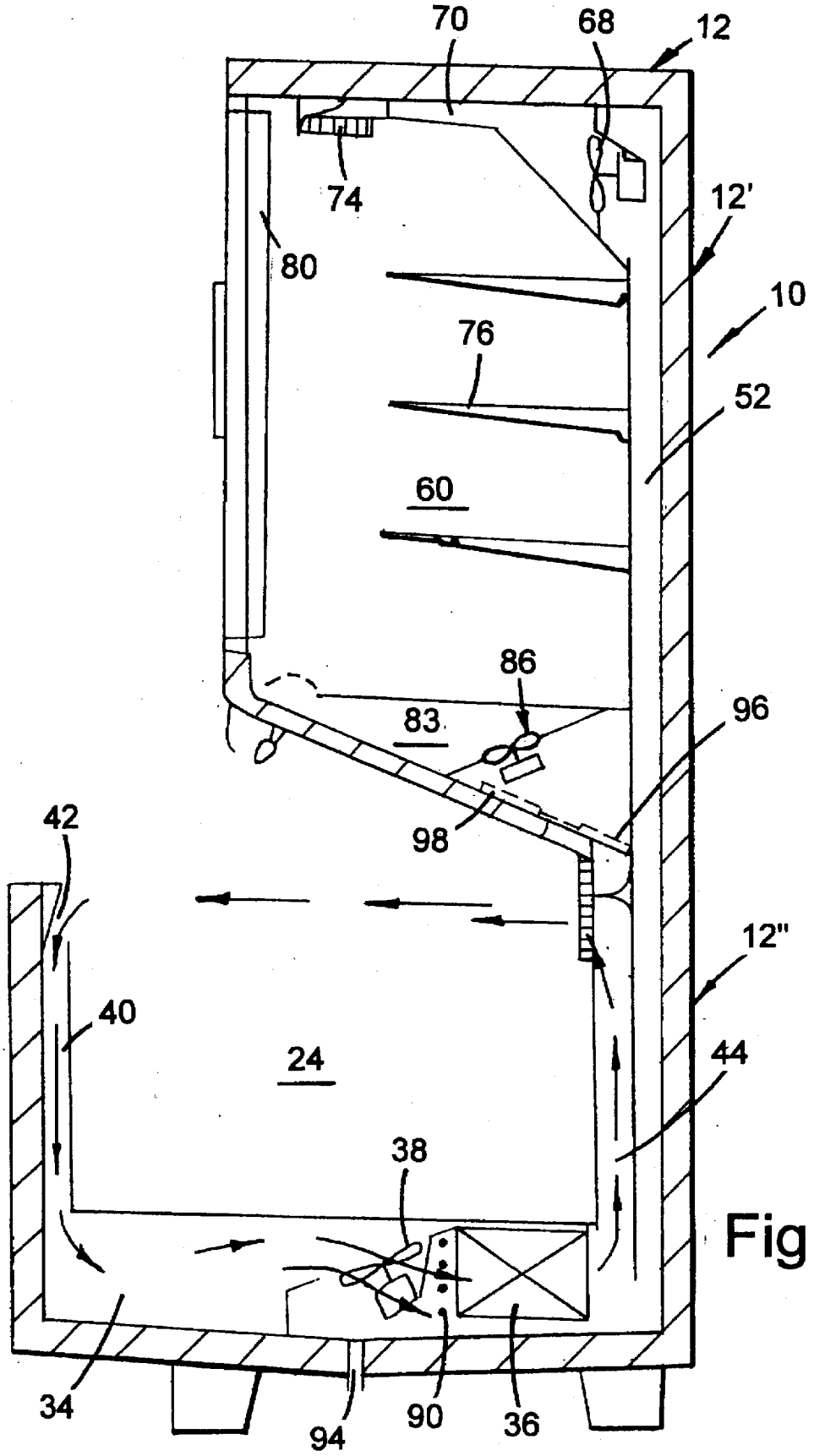
FIG. 2 is a sectional elevational view of the case in FIG. 1, showing air flow during defrost.

Referring now specifically to the drawings, and particularly the first embodiment in FIGS. 1 and 2, the refrigerated display case 10 comprises a housing 12. This housing defines an upper portion 12' and a lower portion 12". Housing 12 has an insulated top 14, back 16, bottom 18 and lower front 20. The assembly may be mounted, for example, on a plurality of feet 22 projecting down from bottom 18. Lower portion 12" projects forwardly beyond the upper portion 12'. Forwardly of the lower part of back panel 16, above bottom 18 and behind front panel 20 is a well-type storage and display space 24. Space 24 is specifically defined by inner storage rear wall 28, inner storage bottom wall 30, and inner storage front wall 32. Storage space 24 has an open top 26. Storage bottom wall 30 is spaced above the case bottom 18 to define a bottom duct 34 which is large enough to receive one or more refrigeration coils 36 of conventional type and a plurality of motor driven fans 38, along the length of the case, for propelling air through coils 36. These coils may be a singular element or a plurality of adjacent elements as desired or necessary. Storage front wall 32 is purposely spaced from housing front wall 20 to define a vertical front air flow duct 40 having an inlet 42 at the upper end thereof and communicating with bottom duct 34 at the lower end thereof. Rear storage wall 28 is spaced from housing rear wall 16 sufficiently to provide a pair of vertical rear ducts, one behind the other. More specifically, the space between these elements is divided by a vertical panel 42 such that, between storage wall 28 and panel 42 is a first rear vertical duct 44, and between panel 42 and end wall 16 is a second vertical duct 52. Duct 44 has its upper end at the top of display space 24. It has a concave air flow deflector 50 and an air flow outlet 46 preferably containing honeycomb air flow control element 47 oriented to direct laminar air flow from duct 44 horizontally across the open top 26 of storage space 24, toward inlet 42 of front duct 40, to form a primary air curtain across the open top of the lower space 24. The concave undersurface of deflector 50 assists in reorienting the vertically flowing air in duct 44 to the horizontal direction. The second rear vertical duct 52 formed between panel 42 and housing rear wall 16 extends from adjacent the bottom of the housing up to the top of the housing, i.e., the top of the upper storage and display space 60.

Upper part 12' of assembly 10 contains the second refrigerated display space 60 which is defined by a display bottom wall 62, upper display back wall 64, top display wall 66, and front doors 80. As shown, walls 64 and 66 can be joined by a sloping wall 66' to create a larger space at the juncture of walls 14 and 16, to receive a second plurality of motor driven fans 68 of conventional design for advancing air from duct 52 at the rear of case 10 to duct 70 across the top of the housing. Duct 70 extends from rear to front so that horizontally flowing air in duct 70, deflected by a diagonal panel 72 through a honeycomb outlet 74 is oriented downwardly through the front of display space 60. The upper duct around upper display space 60 is devoid of refrigeration coils. This display space preferably has a plurality of vertically spaced shelves 76, here shown to be three in number, mounted on rear wall 64 and terminating short of the glass doors 80 to define air flow space from outlet 74, between the front of the shelves and doors 80, to a lower outlet 82. Outlet 82 leads to the space below the bottom panel 62 and a diagonal panel 84 separating the upper and lower portions of the display case. The space between panels 62 and 84 preferably contains a third plurality of motor driven fans 86 to propel air received from the upper display space down through passage 87 to the concavely curved deflector 50 to outlet 88. This outlet preferably contains honeycomb to orient discharged air to cause laminar air flow horizontally across the open top of the lower display space toward inlet 42 to form a secondary air curtain across the open top of lower space 24, parallel to and adjacent the primary air curtain. At least part of this secondary curtain air combines with the primary curtain air to flow into inlet 42.

During refrigeration operation, the evaporative cooling coils have evaporated refrigerant flow within their tubes in conventional manner to cool air flowing transversely therethrough. As depicted by the arrows in FIG. 1, fans 38 propel air through the refrigeration coils 36, with the refrigerated, i.e., cooled, discharge air therefrom flowing into both vertical rear ducts 44 and 52. The air in duct 44 is propelled and travels vertically upwardly to the top of the lower display space 24 where it is deflected by the lower surface of deflector 50 through honeycomb outlet 46, across the open top 26 of the lower refrigerated display space as the primary air curtain, into inlet 42, down through front duct 40 to the lower duct 34, and again through fans 38. This display space 24 is normally for frozen food products, with the air flowing and circulating around this display space being considerably below freezing temperature. Passage of the cold air adjacent storage walls 32, 30 and 28 maintains the below freezing temperature in the space, assisted by the protective air flow across the open top.

During this refrigeration operation, part of the air from fans 32 flows through coils 36, and some preferably flows through a duct portion to bypass the coils, e.g., beneath the coils (or alongside thereof) as depicted by an arrows in FIG. 1, so as not to be further cooled, and aligned with duct 52, to flow into duct 52 where it is drawn all the way up the rear of the case by the second set of fans 68. Because not all of the air has flowed through the refrigeration coils, the temperature of the air circulating around the upper space can be caused to be above that of air around the lower space. These fans then propel the air through the top duct 70 where it is deflected by panel 72 down through outlet 74 containing honeycomb orientation means, to flow vertically down in front of shelves 76 and adjacent glass doors 80 to outlet 82. It then flows into space 83 containing the third set of fans 86 which propel the air downwardly from deflector 50 and through outlet 88 to also flow across the open top of the lower well as a secondary air curtain adjacent the primary air curtain.

The temperatures of air in each duct can be regulated with this invention. Optionally a heater 53 (FIG. 1), or 153 (FIG. 3), can be located in the upper duct to controllably increase air temperature. Thus, by regulating the heater input, and/or the proportion of air flowing in each flow system, and/or the percentage of air flowing through and around the coils, and/or the relative propulsion of the three sets of fans, the temperature in the well space can be kept at a first controlled value, preferably below freezing, while the temperature in the upper space can be kept at a higher controlled value, preferably above freezing.

Figure 7:
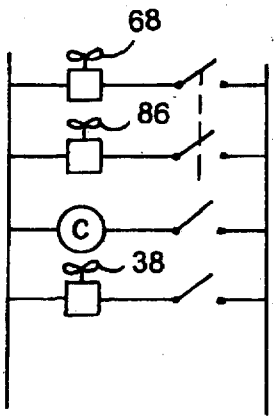
FIG. 7 is a simplified electrical control diagram for the novel case.
Figure 5:
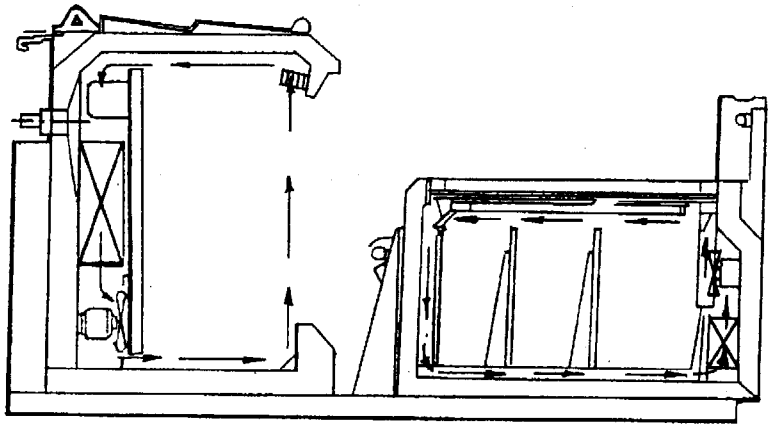
Fig. 5 PRIOR ART
FIG. 5 is a sectional elevational view of a known prior art case.

During defrost operation, the second and third, i.e., upper sets of fans 68 and 86, are deactuated and the evaporative cooling function of refrigeration coils 36 is deactivated, but lower fans 38 continue to operate. Fans 68 and 86 can be deactuated by conventional means such as the relay switches depicted in FIG. 7. The evaporative cooling of the coils can be achieved as by deactivation of the compressor 97. The coils are defrosted by applying heat as by heated air flowing over the surfaces of the coil tubes and fins, or as by forcing hot gas through the coil tubes, as examples. The heated air forced over the surfaces of the coils 36 is heated as by conventional electrical resistance elements 90 (FIG. 2) upstream of the coils, or alternatively by conventional hot gas defrost through the tubes of the coils from the compressor (not shown) in conventional manner, as is known in the trade, or other alternative means of supplying heat to the refrigeration coils 36. This defrosts the coils and any frost on walls 28, 30 and 32. Air exiting from coils 36 travels up duct 44 and is deflected across open top 26 of space 24 to inlet 42 of front duct 40, where it returns to lower duct 34 to assure defrost of the coil. The melted condensate is allowed to exit through a conventional lower outlet 94. Meanwhile, the air in upper storage space, for refrigerated products above freezing temperatures, is dormant, the space remaining substantially cool. Optionally, a closure valve 96 operated by an actuator 98 such as a fluid cylinder to shift valve 96 over the discharge outlet from space 83 can be used to assure no air flow circulation through the upper space 60.

Figure 3:
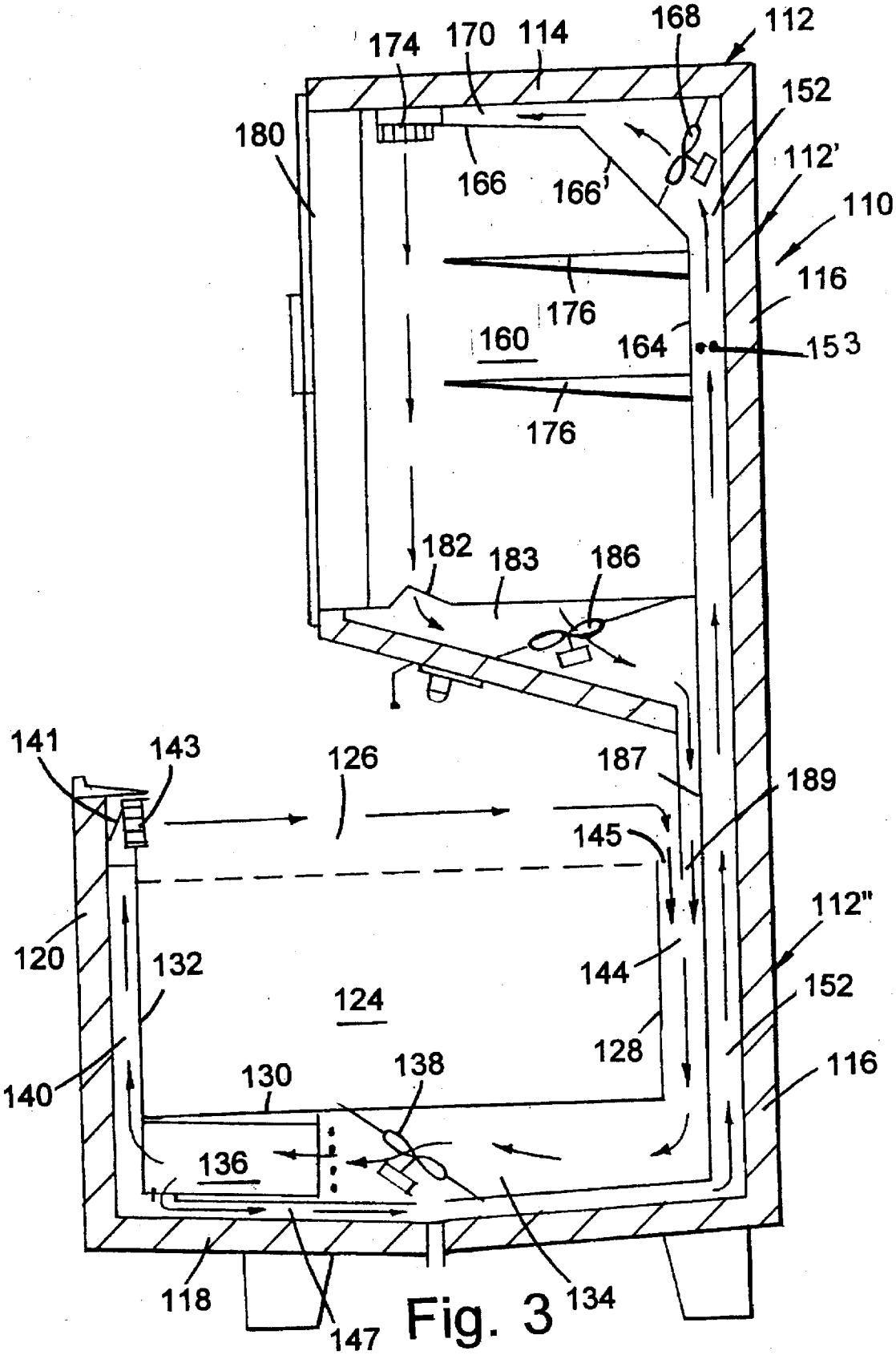
FIG. 3 is an end elevational sectional view of the second embodiment of the novel refrigerated display case, showing air flow during refrigeration.
Figure 4:
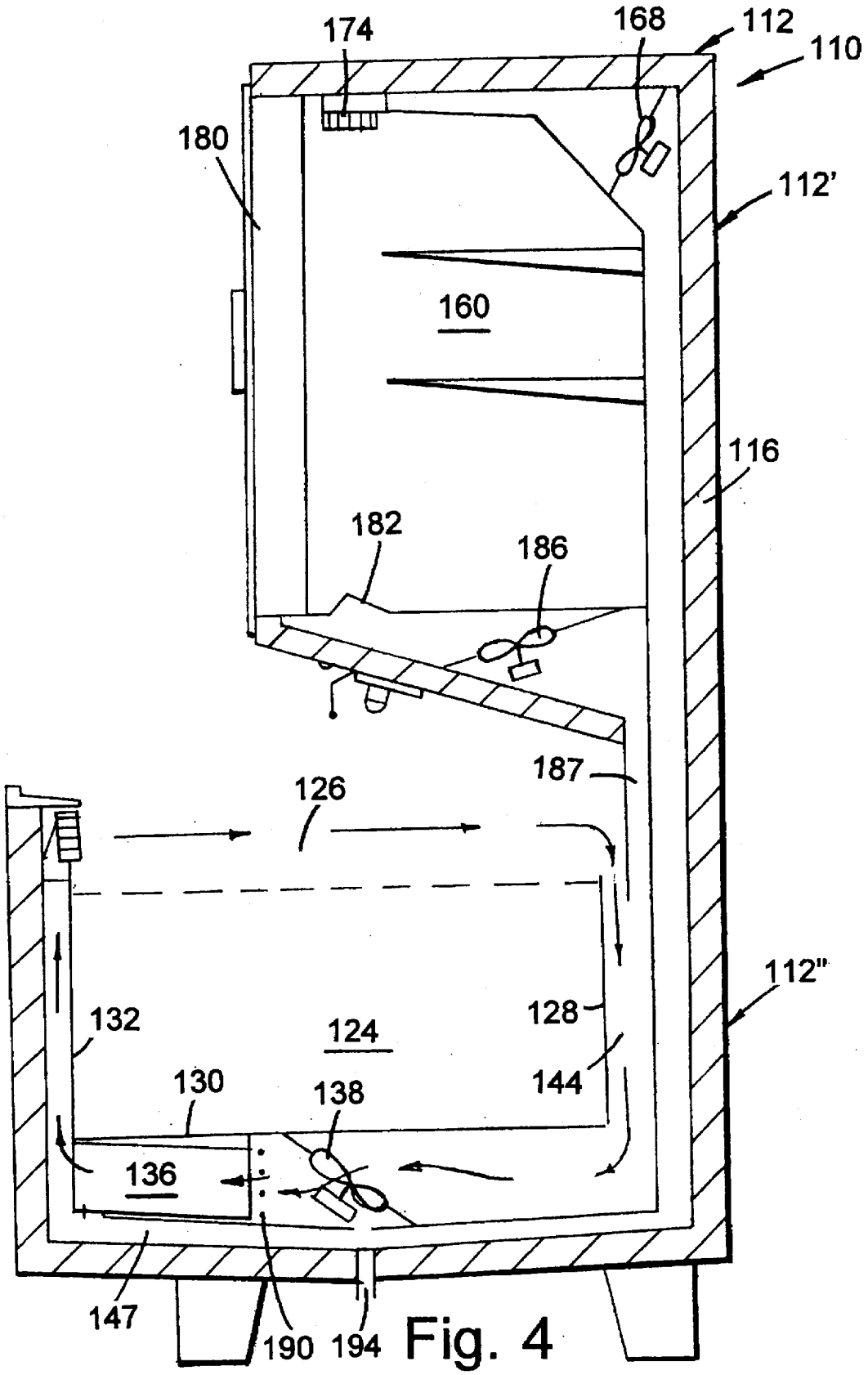
FIG. 4 is a sectional elevational view of the case in FIG. 3 showing air flow during defrost.
Figure 6:
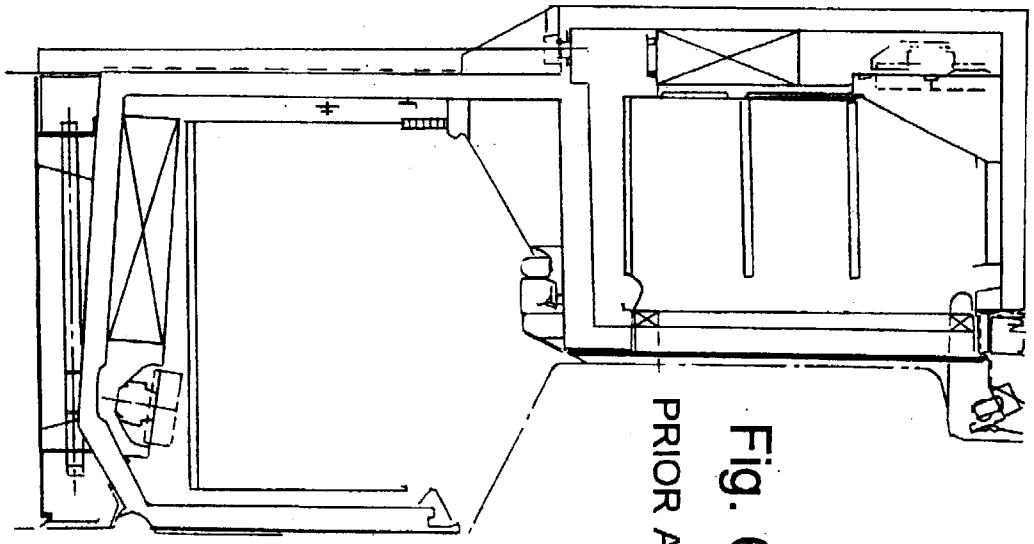
Fig. 6 PRIOR ART
FIG. 6 is a sectional elevational view of a second known prior art case.

Referring now to the second embodiment depicted in FIGS. 3 and 4, the display case 110 includes housing 112 defining upper portion 112' and lower portion 112", the upper portion being a cabinet for display and storage of refrigerated food products above freezing temperature, and the lower portion being a well for display and storage of food products below freezing temperature. The lower refrigerated display space 124 is defined by front storage wall 132, bottom storage wall 130 and rear storage wall 128, all three being spaced from the respective front housing wall 120, bottom housing wall 118, and rear housing wall 116. The front storage wall spacing from housing front wall 120 defines a vertical front duct 140. Bottom storage wall 130 spacing from housing bottom wall 118 defines a large horizontal bottom duct 134 which also contains refrigeration coils 136 and a first plurality of air propulsion motorized fans 138. Rear storage wall 128 spacing from housing wall 116 defines a pair of vertical rear ducts 144 and 152.

Upper portion 112' includes a refrigerated display space 160 containing vertically spaced shelves 176 which are mounted to the rear display wall 164. Wall 164 is spaced from rear housing wall 116 for continuation of duct 152 up the entire vertical length of the housing to the top 114 of the housing. Spaced from housing top 114 is an upper display wall 166 to define a horizontally oriented top duct 170 therebetween. Preferably a panel 166' joining upper wall 166 and back display wall 164 is sloped to define a space for receiving a second plurality of motor driven fans 168 therein. Air flow outlet from top duct 170 is at 174, containing honeycomb oriented downwardly to cause cool recirculating air to flow between the front edges of shelves 176 and doors 180, i.e., in front of shelves 176 and behind and adjacent front doors 180. Air flow outlet 182 at the bottom of space 160 enables air to flow into lower space 183 to a third set of circulating fans 186 along the length of the case. Downstream of fans 186 is a short section of rear duct 187 exiting at outlet 189 into duct 144.

The front duct 140 in this embodiment allows air to flow upwardly therethrough instead of downwardly as in the first embodiment, and includes a deflector 141 for deflecting the vertically moving air horizontally, as oriented at honeycomb outlet 143 to cause laminar air flow horizontally across open top 126 of the well-type refrigerated display space 124 to form a primary air curtain across the open top. This air moves into inlet 145 at the back of the case, the air flowing through this inlet joining that from outlet 189 adjacent thereto to flow through common duct 144 to the refrigeration coils 136.

During refrigeration operation, air circulated around the lower storage and display well is drawn through inlet 145 while air circulated around the upper storage and display cabinet is drawn through outlet 189. Both portions of air flow through duct 144 at the rear, through bottom duct 134, past fans 138 and through refrigeration coils 136 to be cooled. Most of this cooled air exiting from the refrigeration coils flows into and up vertical duct 140 at the front of the case, past deflector 141 and through honeycomb 143 to flow horizontally across open top 126 of display space 124, and recirculated. Contact of the cool air with the rear storage wall 128, bottom storage wall 130 and front storage wall 132 keeps the temperature of the space below freezing as in the first embodiment, assisted by the protective primary air curtain across the open top. A smaller portion of the air exiting from coils 136 flows beneath the coils to a second bottom duct 147 where it flows rearwardly to its juncture with the vertical rear duct 152. It flows up duct 152, through fans 168 which add propulsion, through horizontal top duct 170 and outlet 174, the honeycomb thereof causing the air to flow downwardly in front of shelves 176 and adjacent doors 180, i.e., between the shelves and doors, to outlet 182. After passage through outlet 182 and duct 183, the third set of fans 186 propel it to the rear duct 187 and outlet 189 where it joins air in common rear duct 144 to combine with it and be recirculated. This upper duct system is devoid of refrigeration coils. By regulating the proportion of air flowing in the two different directions from coil 136, the degree of propulsion applied by the three sets of fans, optionally the percentage of circulated air flowing across the refrigeration coil or around it, and/or by use of heater 153, the temperature of the upper display space can be kept at a controlled temperature above freezing, and the lower display case can be kept at a controlled temperature below freezing.

During defrost of this second embodiment, the evaporative function of the coils is deactuated, as well as the second and third sets of fans being deactuated. Fans 138 continue to function so that air continues to flow through the circuit of the lower display space 124, i.e., through coils 136. The coils are heated by any of conventional methods such as those mentioned previously herein, e.g., by electrical resistance heaters 190 or hot gas defrost. This heat melts the frost from the coils, with the melted condensate flowing through outlet 194. The warmed air will also melt any frost from the walls 128, 130 and 132. Meanwhile, however, since fans 168 and 186 are deactuated so as to cease propelling air around upper display space 160, air in this space is basically dormant and remains cool. If desired, a closure valve can be employed on this second embodiment, comparable to that at 96 of the first embodiment.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A refrigerated display case having a refrigeration cycle and a defrost cycle, comprising:

a cabinet defining a lower well space and an upper display space;

said upper display space having a rear wall, at least one shelf projecting forwardly of said rear wall, and front doors for access to said upper display space;

said lower well space having an open top, an air flow duct in the front, below the bottom, and in the back of said lower well space, an air flow outlet from said duct at the upper front or rear of said lower well space, and an air flow inlet to said duct at the opposite upper rear or front of said lower well space;

refrigeration coils in said duct, and lower fans in said duct for circulating air through said coils to be refrigerated, through said outlet and across the open top of said lower well space as an air curtain, through said inlet and back to said bottom duct;

a second duct extending from downstream of said coil, up the back of said lower well space, up the back of said upper display space, and having an opening at the top of said upper space adjacent said front doors to cause refrigerated air to flow down adjacent said front doors;

upper fans in said second duct to cause air flow up said second duct and down adjacent said front doors;

an air outlet from said upper space at a location adjacent said air outlet of said lower well space, for flow of air from said upper space to join recirculated air of said lower space; and defrost means for said air in said lower duct for defrosting said coils during the defrost cycle, while air around said upper display space remains substantially dormant.

2. The refrigerated display case in claim 1 wherein said defrost means comprises electric heaters in said lower duct.

3. The refrigerated display case in claim 1 wherein said defrost means comprises hot gas defrost.

4. The refrigerated display case in claim 1 including a third set of fans adjacent said air junction outlet for propelling cool air from said upper display space to join air flowing from said lower duct outlet across said open top.

5. The refrigerated display case in claim 1 including means for deactuating said upper fans during defrost.

6. The refrigerated display case in claim 4 including means for deactuating said upper fans and said third set of fans during defrost.

7. The refrigerated display case in claim 1 including a closure valve for closing said upper space air outlet during defrost.

8. The refrigerated display case in claim 1 wherein said second duct is devoid of refrigeration coils.

9. The refrigerated display case in claim 1 wherein said first air flow duct has a bypass portion allowing some recirculated air to bypass said coils and flow into said second duct whereby air flow through said second duct around said upper display space will be at a higher temperature than air flow around said lower well space.

10. A refrigerated display case having a refrigeration cycle and a defrost cycle, comprising:

a cabinet defining a lower well space and an upper display space;

said upper display space having a rear wall, at least one shelf projecting forwardly of said rear well, and front doors for access to said upper space;

said lower well space having an open top, an air flow duct in the front, and below the bottom, and in the back of said lower well space, an air flow outlet from said duct at the upper rear of said lower well space, and an air flow inlet to said duct at the upper front of said lower well space;

refrigeration coils in said duct, and lower fans in said duct for circulating refrigeration air through said coils, up said back, through said outlet and across the open top of said lower well space as a primary air curtain, through said inlet and down said front duct to said bottom duct;

a second duct extending from downstream of said coils, up the back of said lower well space, up the back of said upper display space, and having an opening at the top of said upper space adjacent said front doors to cause refrigerated air to flow down adjacent said front doors;

upper fans in said second duct to cause air flow up said second duct and down adjacent said doors;

an air junction outlet from said upper space to said lower space at a location adjacent said air outlet of said lower space, for flow of air from said upper space to form a secondary air curtain adjacent said primary air curtain across said open top of said lower space; and defrost means for said air in said lower duct for defrosting said coils during a defrost cycle while air around said upper display space remains substantially dormant.

11. The refrigerated display case in claim 10 including a third set of fans for propelling cool air from said upper display space.

12. The refrigerated display case in claim 10 including means for deactuating said upper fans during defrost.

13. The refrigerated display case in claim 10 including means for deactuating said upper fans and said third set of fans during defrost.

14. The refrigerated display case in claim 10 including a closure valve for closing said upper space air outlet during defrost.

15. The refrigerated display case in claim 10 wherein said second duct is devoid of refrigeration coils.

16. The refrigerated display case in claim 10 wherein said first air flow duct has a bypass portion allowing some recirculated air to bypass said coils and flow into said second duct whereby air flow through said second duct around said upper display space will be at a higher temperature than air flow around said lower well space.

17. A refrigerated display case having a refrigeration cycle and a defrost cycle, comprising:

a cabinet defining a lower well space and an upper display space;

said upper display space having a rear wall, at least one shelf projecting forwardly of said rear wall, and front doors for access to said upper display space;

said lower well space having an open top, an air flow duct in the front, below the bottom, and in the back of said lower well space, an air flow outlet from said duct at the upper front or rear of said lower well space, and an air flow inlet to said duct at the opposite upper rear or front of said lower well space;

refrigeration coils in said duct, and lower fans in said duct for circulating air through said coils to be refrigerated, through said outlet and across the open top of said lower well space as an air curtain, through said inlet and back to said bottom duct;

said duct having a portion bypassing said refrigeration coils to allow flow of a predetermined portion of recirculated air to pass; a second duct extending from downstream of said coil, up the back of said lower well space, up the back of said upper display space, and having an opening at the top of said upper space adjacent said front doors to cause refrigerated air to flow down adjacent said front doors;

said bypassing portion being aligned with said second duct whereby air flowing in said second duct is at a higher temperature than air flowing around said lower well space;

upper fans in said second duct to cause air flow up said second duct and down adjacent said front doors;

said second duct being devoid of refrigeration coils; and defrost means for said air in said lower duct for defrosting said coils during the defrost cycle, while air around said upper display space remains substantially dormant.

18. A refrigerated display case having a refrigeration cycle and a defrost cycle, comprising:

a cabinet defining a lower well space and an upper display space;

said upper display space having a rear wall, at least one shelf projecting forwardly of said rear wall, and front doors for access to said upper display space;

said lower well space having an open top, a first air flow duct in the front, below the bottom, and in the back of said lower well space, an air flow outlet including flow orienting honeycomb from said duct at the upper front of said lower well space, and an air flow inlet to said duct at the upper rear of said lower well space;

refrigeration coils in said first duct, and lower fans in said duct for circulating air through said coils to be refrigerated, through said outlet and across the open top of said lower well space as an air curtain, through said inlet and back to said bottom duct;

a second duct extending from downstream of said coil, up the back of said upper display space, and having an opening at the top of said upper space adjacent said front doors to cause refrigerated air to flow down adjacent said front doors;

upper fans in said second duct to cause air flow up said second duct and down adjacent said front doors;

an air outlet from said upper space at a location adjacent said air outlet of said lower wall space, for combining the air flow of said first duct and said second duct; and defrost means for defrosting said coils during the defrost cycle.

19. A refrigerated display case having a refrigeration cycle and a defrost cycle, comprising:

a cabinet defining a lower well space and an upper display space;

said upper display space having a rear wall, at least one shelf projecting forwardly of said rear well, and front doors for access to said upper space;

said lower well space having an open top, a lower air flow duct in the front, and below the bottom, and in the back of said lower well space, an air flow outlet from said duct at the upper rear or front of said lower well space, and an air flow inlet to said duct at the upper front or rear of said lower well space;

refrigeration coils in said duct, and lower fans in said duct for circulating refrigeration air through said coils, through said outlet and across the open top of said lower well space as an air curtain, through said inlet and down to said bottom duct;

a second duct extending from downstream of said coils, up the back of said lower well space, up the back of said upper display space, and having an opening at the top of said upper space adjacent said front doors to cause refrigerated air to flow down adjacent said from doors;

upper fans in said second duct to cause air flow up said second duct and down adjacent said doors;

means for increasing the temperature of air flowing through said second duct to cause said temperature to be higher than the temperature of air flowing through said lower duct; and defrost means for said air in said lower duct for defrosting said coils during a defrost cycle.

20. The refrigerated display case in claim 19 wherein said temperature increasing means is a heater in said second duct.

21. The refrigerated display case in claim 19 wherein said temperature increasing means is a bypass of said refrigeration coils for a portion of air to said second duct.

* * * * *

UNITED STATES PATENT AND TRADEMARK OFFICE

CERTIFICATE OF CORRECTION

PATENT NO. : 5,675,983
DATED : October 14, 1997
INVENTOR(S) : Fayez F. Ibrahim

It is certified that error appears in the above-identified patent and that said Letters Patent is hereby corrected as shown below:

Column 6, claim 1, line 8;

"wail" should be --wall--;

Column 9, claim 19, line 5;

"from" should be --front--.

Signed and Sealed this

Twentieth Day of January, 1998

*Attest:*

BRUCE LEHMAN

*Attesting Officer*

*Commissioner of Patents and Trademarks*